US008467695B2

(12) United States Patent
Akashi

(10) Patent No.: US 8,467,695 B2
(45) Date of Patent: Jun. 18, 2013

(54) IMAGE FORMING APPARATUS, CONTROL METHOD, AND STORAGE MEDIUM FOR MEASURING THE TEMPERATURE OF A FIXING UNIT, SELECTING A SHEET TYPE TO BE USED FOR COOLING THE FIXING UNIT BASED ON THE MEASURED TEMPERATURE, AND PERFORMING CONTROL SO THAT A SHEET OF THE SELECTED TYPE PASSES THROUGH THE FIXING UNIT WHEN THE MEASURED TEMPERATURE IS HIGHER THAN A PREDETERMINED TEMPERATURE

(75) Inventor: Masamichi Akashi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 12/898,557

(22) Filed: Oct. 5, 2010

(65) Prior Publication Data

US 2011/0085814 A1 Apr. 14, 2011

(30) Foreign Application Priority Data

Oct. 14, 2009 (JP) ..... 2009-237291

(51) Int. Cl.
*G03G 15/20* (2006.01)

(52) U.S. Cl.
USPC ..... 399/69

(58) Field of Classification Search
USPC ... 399/67, 69, 92, 94, 328, 330, 334; 219/216
See application file for complete search history.

(56) References Cited

U.S. PATENT DOCUMENTS

| | | | | |
|---|---|---|---|---|
| 5,787,321 | A * | 7/1998 | Nishikawa et al. | 399/69 |
| 6,532,348 | B2 * | 3/2003 | Allmendinger | 399/69 |
| 7,398,028 | B2 | 7/2008 | Nakagaki | |
| 7,561,818 | B2 | 7/2009 | Arimoto | |
| 7,792,452 | B2 * | 9/2010 | Fujikura | 399/69 |
| 8,224,202 | B2 * | 7/2012 | Urano | 399/69 |
| 8,254,802 | B2 * | 8/2012 | Hanashi et al. | 399/92 |
| 8,265,505 | B2 * | 9/2012 | Mills et al. | 399/69 |

FOREIGN PATENT DOCUMENTS

| | | |
|---|---|---|
| JP | 2006-220681 A | 8/2006 |
| JP | 2007-079041 A | 3/2007 |
| JP | 2008-159668 A | 7/2008 |

* cited by examiner

*Primary Examiner* — William J Royer
(74) *Attorney, Agent, or Firm* — Canon U.S.A., Inc., IP Division

(57) ABSTRACT

An image forming apparatus capable of rapidly cooling a fixing device is provided. A fixing unit of an image forming apparatus (MFP) includes a fixing device for fixing a developer image transferred onto a sheet based on image data, a temperature sensor for measuring the temperature of the fixing device, a heater for raising the temperature thereof, and a cooling device for cooling thereof. A control unit of the MFP acquires sheet information in which information for adjusting the temperature of the fixing device is described, selects a suitable cooling sheet to be used for cooling the fixing device based on the acquired sheet information and the temperature of the fixing device measured by the temperature sensor, and passes the selected cooling sheet through the fixing device to cool the fixing device when the temperature of the fixing device measured by the temperature sensor is higher than a predetermined temperature.

10 Claims, 13 Drawing Sheets

FIG.9

| GRAMMAGE ($g/m^2$) | SURFACE QUALITY | APPROPRIATE FIXING TEMPERATURE (°C) | t1 (°C) | t2 (°C) | tmax (°C) |
|---|---|---|---|---|---|
| 52-63 | PLAIN PAPER | 170-180 | 182 | 185 | 200 |
| 64-105 | PLAIN PAPER | 180-190 | 192 | 195 | 210 |
| 106-220 | PLAIN PAPER | 190-200 | 202 | 205 | 220 |
| 221-300 | PLAIN PAPER | 200-210 | 212 | 215 | 230 |

IMAGE FORMING APPARATUS, CONTROL METHOD, AND STORAGE MEDIUM FOR MEASURING THE TEMPERATURE OF A FIXING UNIT, SELECTING A SHEET TYPE TO BE USED FOR COOLING THE FIXING UNIT BASED ON THE MEASURED TEMPERATURE, AND PERFORMING CONTROL SO THAT A SHEET OF THE SELECTED TYPE PASSES THROUGH THE FIXING UNIT WHEN THE MEASURED TEMPERATURE IS HIGHER THAN A PREDETERMINED TEMPERATURE

BACKGROUND OF THE INVENTION

1. Field of the Invention

The present invention relates to an image forming apparatus that increases printing productivity by temperature control of a fixing device.

2. Description of the Related Art

Conventionally, as a technique concerning temperature control of a fixing device, a method is known which executes cooling of the fixing device by turning a ventilation port of an air blower toward the fixing device to blow air to the fixing device (e.g., refer to Japanese Patent Application Laid-Open No. 2007-79041). Further, a method is also discussed which uses a coolant such as water (e.g., refer to Japanese Patent Application Laid-Open No. 2006-220681). Furthermore, a technique is discussed in which whether an image is transferred to a sheet is controlled according to whether image processing is fast enough compared with a speed of a printing device, thereby preventing the temperature rise of a fixing device (e.g., refer to Japanese Patent Application No. 2008-159668).

However, in the methods according to the conventional technique described above, a user needs to wait for a longtime until the fixing device is cooled when printing including a sheet different in fixing temperature is executed. Thus, there is a problem that significantly reduces productivity. This problem significantly appears when a sheet that requires a particularly high fixing temperature is changed to a sheet low in fixing temperature. Further, when printing using a small sized sheet is continuously executed, there is also a problem in which the temperature only at the edge of the fixing device rises.

SUMMARY OF THE INVENTION

The present invention is directed to an image forming apparatus capable of rapidly cooling a fixing device.

According to an aspect of the present invention, an image forming apparatus includes an input unit configured to input image data, a transfer unit configured to transfer a developer image (toner image) corresponding to image data input by the input unit to a sheet, a fixing unit configured to fix the developer image (toner image) transferred by the transfer unit on the sheet, a measuring unit configured to measure the temperature of the fixing unit, a selection unit configured to select a sheet type to be used for cooling the fixing unit based on the temperature measured by the measuring unit, and a control unit configured to control so as to pass a sheet of the type selected by the selection unit through the fixing unit when the temperature measured by the measuring unit is higher than a predetermined temperature.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 is a diagram illustrating an example of sheet information to be acquired in step S202 illustrated in FIG. 8.

DESCRIPTION OF THE EMBODIMENTS

Various exemplary embodiments, features, and aspects of the invention will be described in detail below with reference to the drawings.

Figure 1:
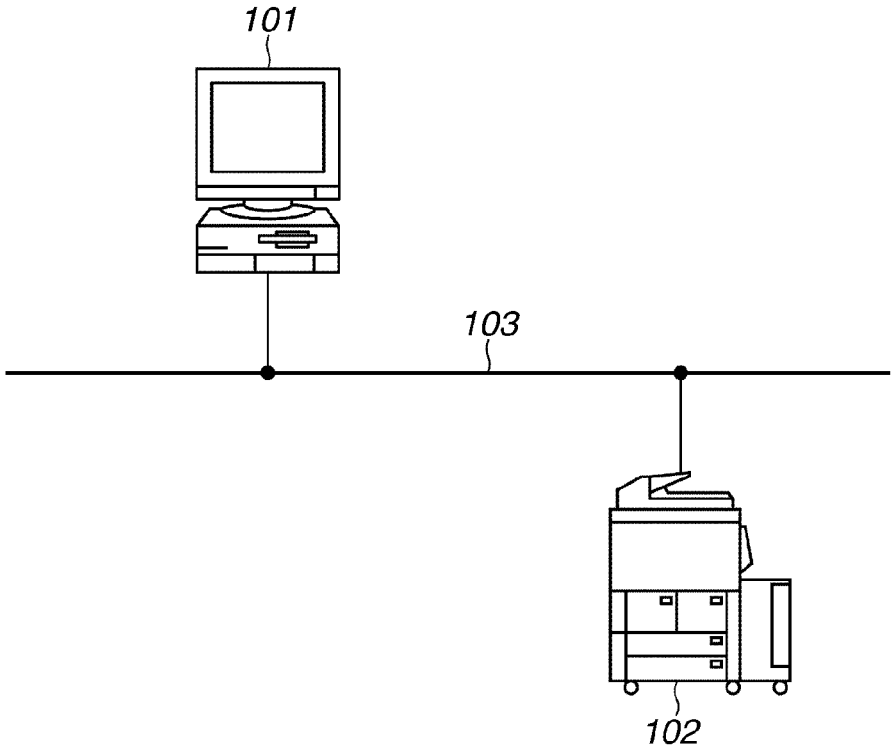
FIG. 1 is a diagram illustrating a configuration example of an image processing system including an image forming apparatus (multi-function peripheral (MFP)) according to an exemplary embodiment of the present invention.

FIG. 1 is a diagram illustrating a configuration example of an image processing system including an image forming apparatus according to an exemplary embodiment of the present invention.

In this image processing system, a personal computer (PC) 101 and a multi-function peripheral (MFP) (digital multi-function peripheral) 102 are communicably connected via a network 103. The MFP 102 is an example of an image forming apparatus according to the present invention. The image forming apparatus according to the present invention absolutely includes a printing function. As described below, the MFP 102 includes a scanner function, a facsimile function, and the like.

The connection between the PC 101 and the MFP 102 may be a local connection (e.g., universal serial bus (USB) interface connection).

Figure 2:
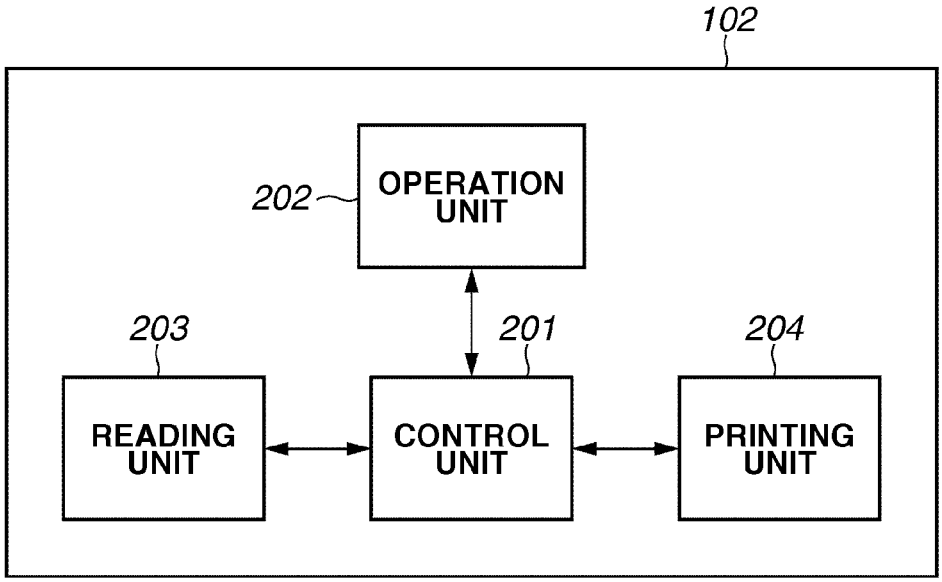
FIG. 2 is a block diagram illustrating a configuration of the MFP.

FIG. 2 is a block diagram illustrating a configuration of the MFP 102. The MFP 102 generally includes a control unit 201, an operation unit 202, a reading unit 203, and a printing unit 204. The control unit 201 controls the operation unit 202, the reading unit 203, and the printing unit 204. The details of the control unit 201 will be described in detail later referring to FIG. 3.

The operation unit 202 includes a display unit and an input unit (not illustrated). The display unit provides a user with an operation screen on the MFP 102. The input unit receives various operations to the MFP 102 from the user. The reading unit 203 is a scanner. The reading unit 203 reads image data from a document and inputs it to the control unit 201. The printing unit 204 executes image transfer to a sheet based on image data processed by the control unit 201.

Figure 3:
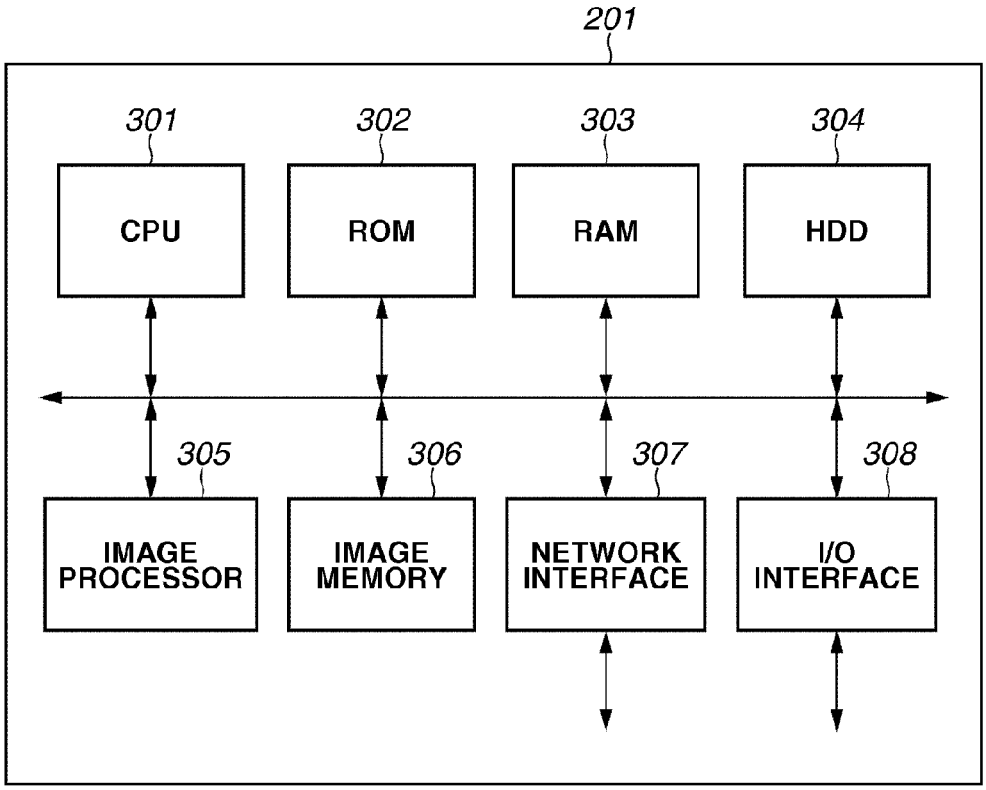
FIG. 3 is a block diagram illustrating a configuration of a control unit in an MFP.

FIG. 3 is a block diagram illustrating a configuration of the control unit 201.

The control unit 201 includes a central processing unit (CPU) 301. The control unit 201 further includes a read only memory (ROM) 302, a random access memory (RAM) 303, a hard disk drive (HDD) 304, an image processor 305, an image memory 306, a network interface 307, and input/output (I/O) interface 308 which are controlled by the CPU 301.

The CPU 301 controls the operation unit 202, the reading unit 203, and the printing unit 204, which are components of the MFP 102, and apparatuses constructing the control unit 201 (above-described ROM 302 to I/O interface 308) based on a program expanded in the RAM 303.

The ROM 302 is a nonvolatile storage medium. The ROM 302 stores a boot program or the like to be executed by the CPU 301. The RAM 303 is a volatile storage medium. An operating system (OS) or application programs that are executed by the CPU 301 are expanded in the RAM 303. The HDD 304 is a nonvolatile storage medium. The HDD 304 stores an OS and application programs that are executed by the CPU 301.

The image processor 305 functions as an image processing unit configured to execute various types of image processing to image data stored in the image memory 306. The image memory 306 is a volatile storage medium. The image memory 306 temporarily stores image data input from the reading unit 203 and the network interface 307.

The network interface 307 executes input and output of various types of data such as image data and job control data between the MFP 102 and external apparatuses such as the PC 101. The I/O interface 308 executes input and output of data between a bus, to which each of the operation unit 202, the reading unit 203, and the printing unit 204 is connected, and the control unit 201.

Figure 4:
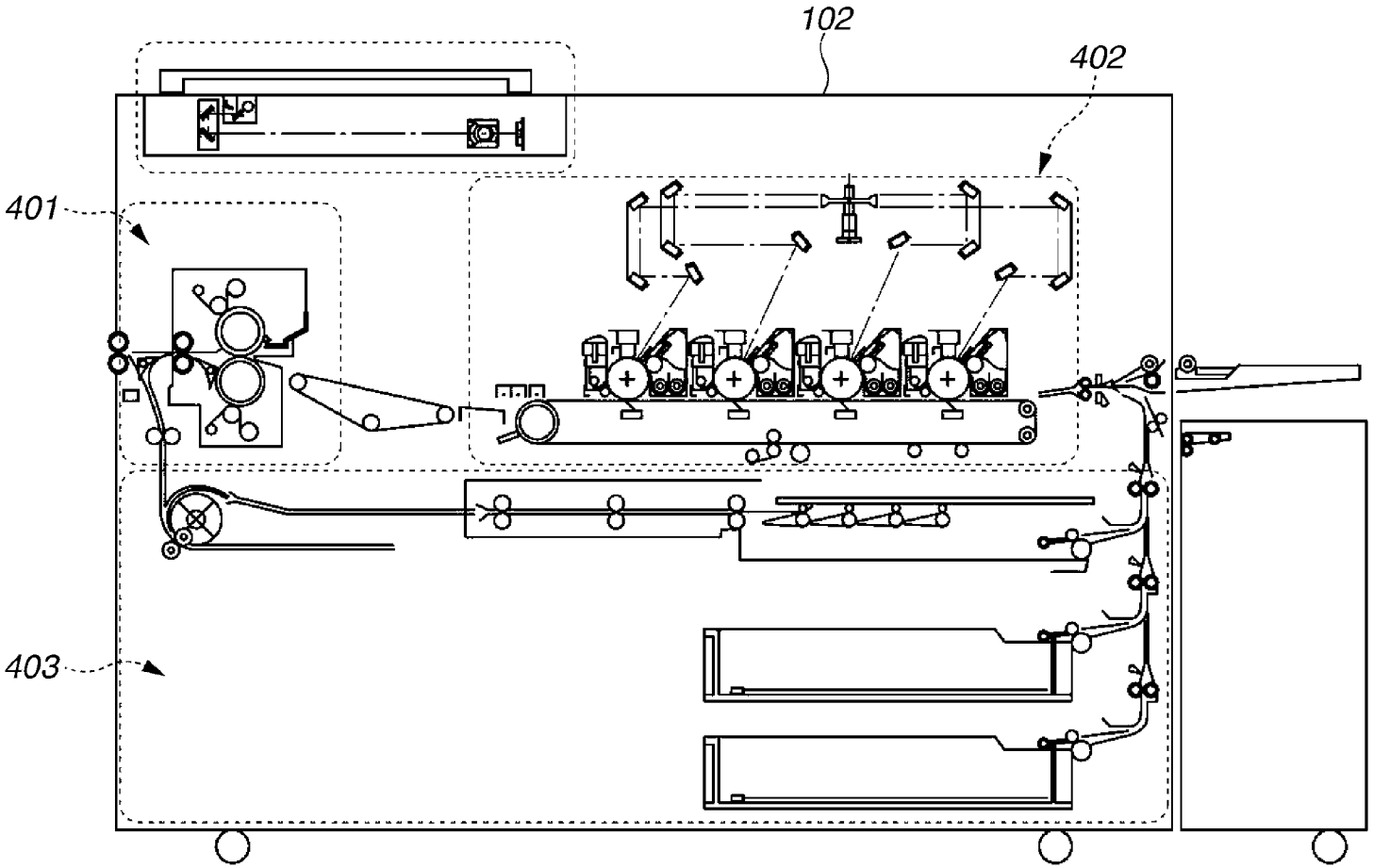
FIG. 4 is a cross section illustrating a schematic structure of the MFP.

FIG. 4 is a cross section illustrating a schematic structure of the MFP 102.

The MFP 102 generally includes a fixing unit 401, a transfer unit 402, and a sheet feed conveyance unit 403. These are also the configuration of the printing unit 204.

Figure 5:
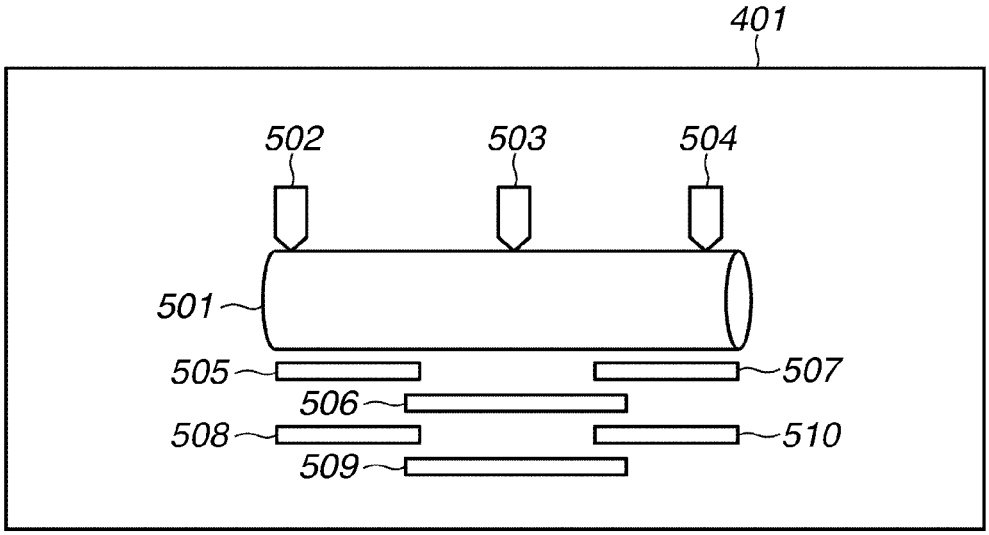
FIG. 5 is a diagram illustrating a schematic configuration of a fixing unit included in the MFP.

FIG. 5 is a block diagram illustrating the configuration of the fixing unit 401 in detail.

In the fixing unit 401, a fixing device 501 fixes a toner image, which is formed on a sheet, on the sheet by heat and pressure processing. Further, the temperature of the fixing device 501 is measured by temperature sensors 502, 503, and 504 (temperature measuring units). In order to measure temperatures at a plurality of locations of the fixing device 501, the temperature sensor 503 is disposed at the center, and the temperature sensors 502 and 504 are disposed at both ends of the fixing device 501.

The fixing device 501 is heated by heaters 505, 506, and 507 (heating units). Like the temperature sensors 502 to 504, the heater 506 is disposed at the center, and the heaters 505 and 507 are disposed at both ends of the fixing device 501. Cooling of the fixing device 501, when the temperature of the fixing device 501 excessively rises, is executed by cooling devices 508, 509, and 510 (cooling units).

As the cooling devices 508, 509, and 510, typically a fan, a peltiert element, or the like is used. Like the heaters 505 to 507, the cooling device 509 is disposed at the center, and the cooling devices 508 and 510 are disposed at both ends of the fixing device 501.

In print processing in the printing unit 204, the CPU 301 controls each device constructing the MFP 102 to execute the print processing as follows. First, a sheet is fed from the sheet feed conveyance unit 403 to the transfer unit 402. In the transfer unit 402, image transfer of a developer image is executed on the fed sheet.

Subsequently, in the fixing unit 401, the fixing device 501 is caused to reach the appropriate fixing temperature using the suitable heaters 505 to 507 and cooling devices 508 to 510 according to a sheet type and a sheet size conveyed from the sheet feed conveyance unit 403. In this state, in the fixing unit 401, image fixing of the developer image onto the sheet, on which an image is transferred, is executed.

The detail configuration of the transfer unit 402 is not illustrated herein. Roughly, the transfer unit 402 includes a photosensitive member, a charging unit, an exposure unit, and a developing unit. The photosensitive member transfers an image to a sheet. The charging unit charges the photosensitive member. The exposure unit exposes the charged photosensitive member with a laser to generate an electrostatic latent image. The developing unit develops the electrostatic latent image generated on the photosensitive member using a developer (e.g., toner).

In transfer processing in the transfer unit 402, the CPU 301 controls each component of the transfer unit 402 to execute the transfer processing as follows. First, bit map data generated by image processing is converted, by the CPU 301, into irradiation data used for irradiating a laser beam.

Subsequently, the photosensitive member is charged by the charging unit. Then, exposure of the charged photosensitive member is executed by the exposure unit with a laser beam based on the converted irradiation data. Then, the electrostatic latent image is generated. Next, the electrostatic latent image generated on the photosensitive member is developed by the developing unit using a developer (e.g., toner) and a developer image is formed.

Thereafter, in the fixing unit 401, the developer image is transferred to and fixed on a sheet. Then, the sheet is output to a paper discharge tray included in the sheet feed conveyance unit 403.

A job that is executed by the MFP 102 configured as described above includes COPY, PRINT, FAX, SEND, BOX.

"COPY" refers to processing to print image data read in the reading unit 203, by the printing unit 204. "PRINT" refers to processing to print image data received from the PC 101 through the network interface 307, by the printing unit 204. "FAX" refers to processing to transmit image data or the like read by the reading unit 203 outside, or receive image data from the outside through a telephone line.

"SEND" refers to processing to transmit image data or the like read by the reading unit 203 outside through the network 103. "BOX" refers to processing to store image data or the like read by the reading unit 203 in a storage medium such as the HDD 304.

Next, print processing by the MFP 102 will be described. In the present exemplary embodiment, image data of a plurality of pages are printed on a plurality of printing sheets. When one sheet is defined as a first sheet among the plurality of these sheets, a sheet subsequent to the first sheet is defined as a second sheet.

Figure 6:
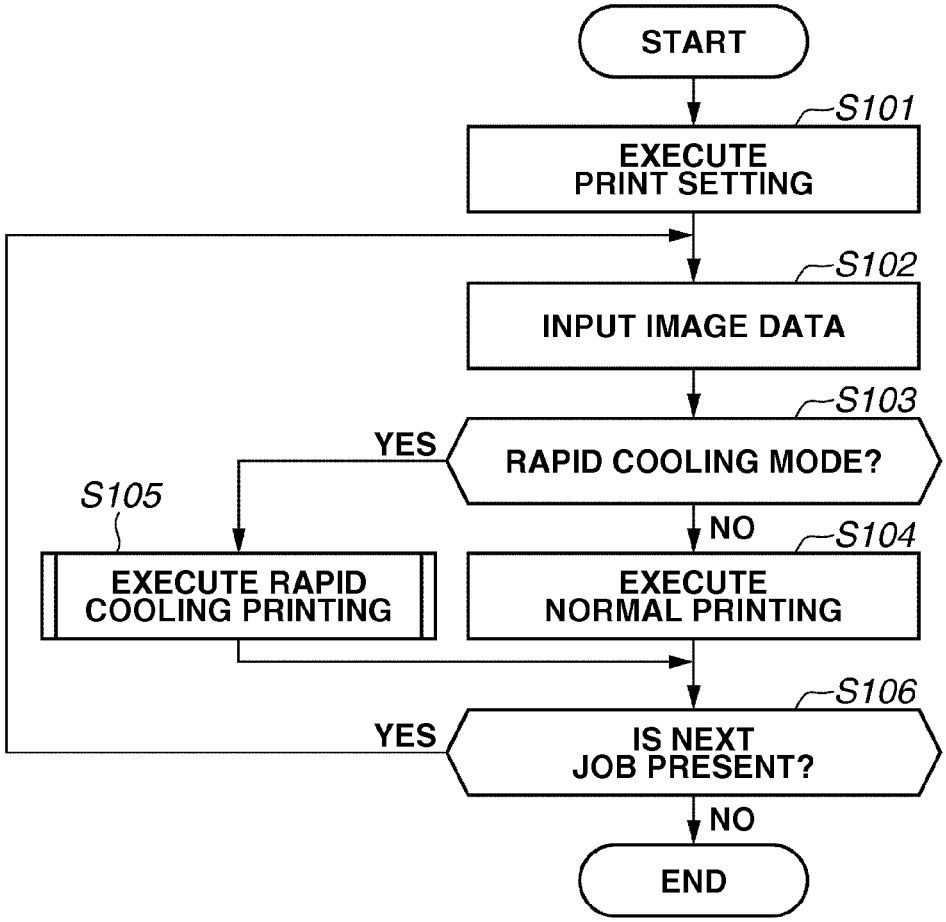
FIG. 6 is a flowchart illustrating a flow of print processing performed by the MFP.

FIG. 6 is a flowchart illustrating a flow of print processing by the MFP 102. The processing illustrated in FIG. 6 is realized by the CPU 301 reading a program stored in the HDD 304 into the RAM 303, expanding it, and executing it.

First, in step S101, the print setting of the MFP 102 is executed from the operation unit 202. In the print setting in step S101, not only a normal print setting (e.g., sheet size, number of prints, selection of monochrome print/color print, or the like) but also the setting of "printing mode", which will be described below, are executed. The print setting in step S101 can be omitted if the setting has already been executed.

Figure 7:
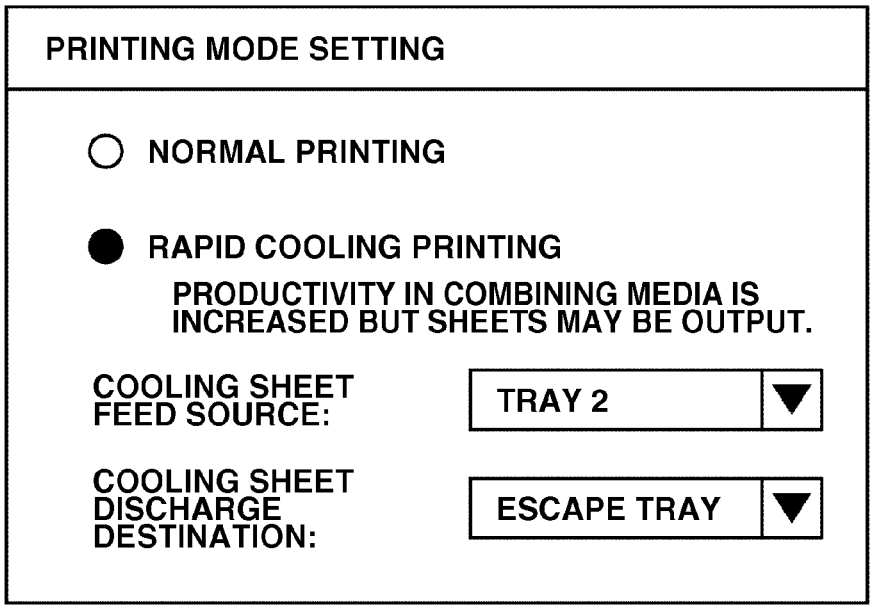
FIG. 7 illustrates an example of a screen displayed on an operation unit on the MFP when setting a printing mode to be executed in print setting performed in step S101 illustrated in FIG. 6.

FIG. 7 illustrates an example of a screen displayed on the operation unit 202 when setting a printing mode to be executed in step S101. As illustrated in FIG. 7, in the MFP 102, the printing mode can be selected from between two modes of "normal printing mode" and "rapid cooling printing mode".

"Normal printing mode" refers to a conventional printing mode. When it is required to cool the temperature of the fixing device 501 due to a change of a printing sheet, a user needs to wait until it is cooled.

"Rapid cooling printing mode" refers to a printing mode characteristic for the present exemplary embodiment, and will be described in detail later referring to FIG. 8. In "rapid cooling printing mode", in short, a cooling sheet is selected when the temperature of the fixing device 501 rises, a developer is placed on a portion of the cooling sheet where the temperature becomes relatively high, and printing is executed. Thus, the fixing device 501 can uniformly and rapidly be cooled.

As illustrated in FIG. 7, when "rapid cooling printing mode" is selected, with respect to a sheet to be used for cooling, an optional sheet feed destination and an optional sheet discharge destination can be selected.

Subsequent to step S101, in step S102, image data to be printed by the MFP 102 is input from the network interface 307 or the reading unit 203. Next, in step S103, it is determined whether "rapid cooling printing mode" is selected in step S101.

If it is determined that "rapid cooling printing mode" is not designated (NO in step S103), the processing proceeds to step S104. On the other hand, if it is determined that "rapid cooling printing mode" is designated (YES in step S103), the processing proceeds to step S105.

In step S104, normal printing is executed for image data input in step S102. Further, in step S105, the rapid cooling printing is executed for image data input in step S102. Details of the rapid cooling printing will be described below referring to FIG. 8.

After the processing in steps S104 or S105 is completed, then in step S106, it is determined whether a job to be executed next remains. "Job to be executed next" refers to print processing to be executed on a second sheet after printing on a first sheet is finished.

If it is determined that a job to be executed remains (YES in step S106), the processing returns to step S102. Then, the above-described processing is repeated. On the other hand, if it is determined that a job to be executed does not remain (NO in step S106), the processing ends.

Figure 8:
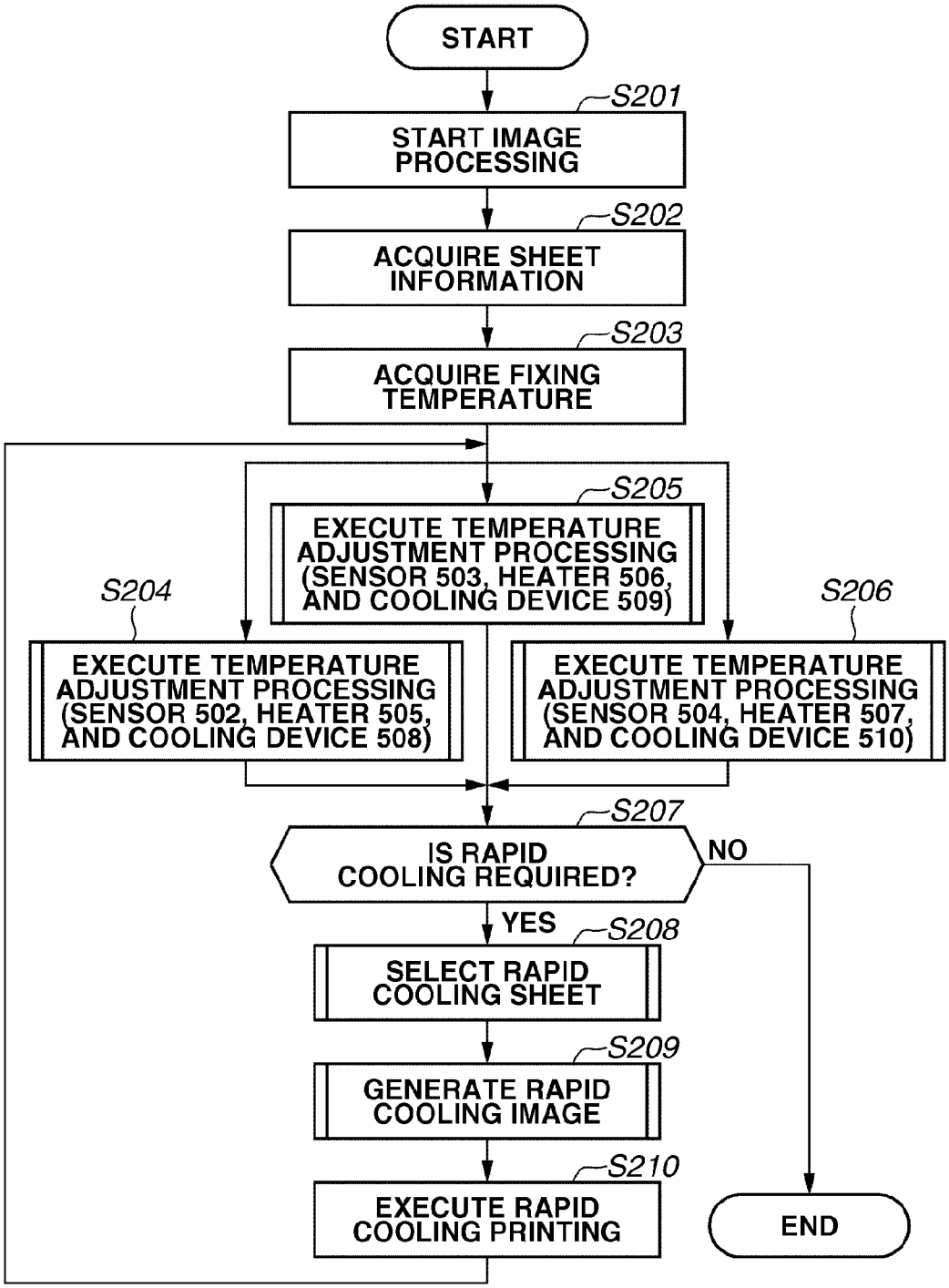
FIG. 8 is a flowchart illustrating details of a flow of rapid cooling printing processing to be executed in step S105 illustrated in FIG. 6.

FIG. 8 is a flowchart illustrating details of the flow of processing of rapid cooling printing to be executed in step S105. The processing illustrated in the flowchart in FIG. 8 is realized by the CPU 301 reading a program stored in the HDD 304 into the RAM 303, expanding it, and executing it.

First, in step S201, image processing is started by the image processor 305 for the image data input in step S102 (refer to FIG. 6). The image processing includes, for example, image processing to convert image data in a page description language format into image data in a bit map format.

Subsequently, in step S202, sheet information stored in the HDD 304 is acquired. The CPU 301 executes a predetermined program to function as such a sheet information acquisition unit. This "sheet information" will be described below referring to FIG. 9.

Next, in step S203, a fixing temperature (information concerning fixing temperature) is acquired from the sheet information acquired in step S202.

In step S204, based on the fixing temperature acquired in step S203, temperature adjustment processing is executed by the temperature sensor 502, the heater 505, and the cooling device 508 in the fixing unit 401. Simultaneously, in step S205, temperature adjustment processing is executed by the temperature sensor 503, the heater 506, and the cooling device 509. Also, in step S206, temperature adjustment processing is executed by the temperature sensor 504, the heater 507, and the cooling device 510. In these three types of temperature adjustment processing, the contents of processing are similar. The detailed contents will be described below referring to FIG. 10.

Figure 10:
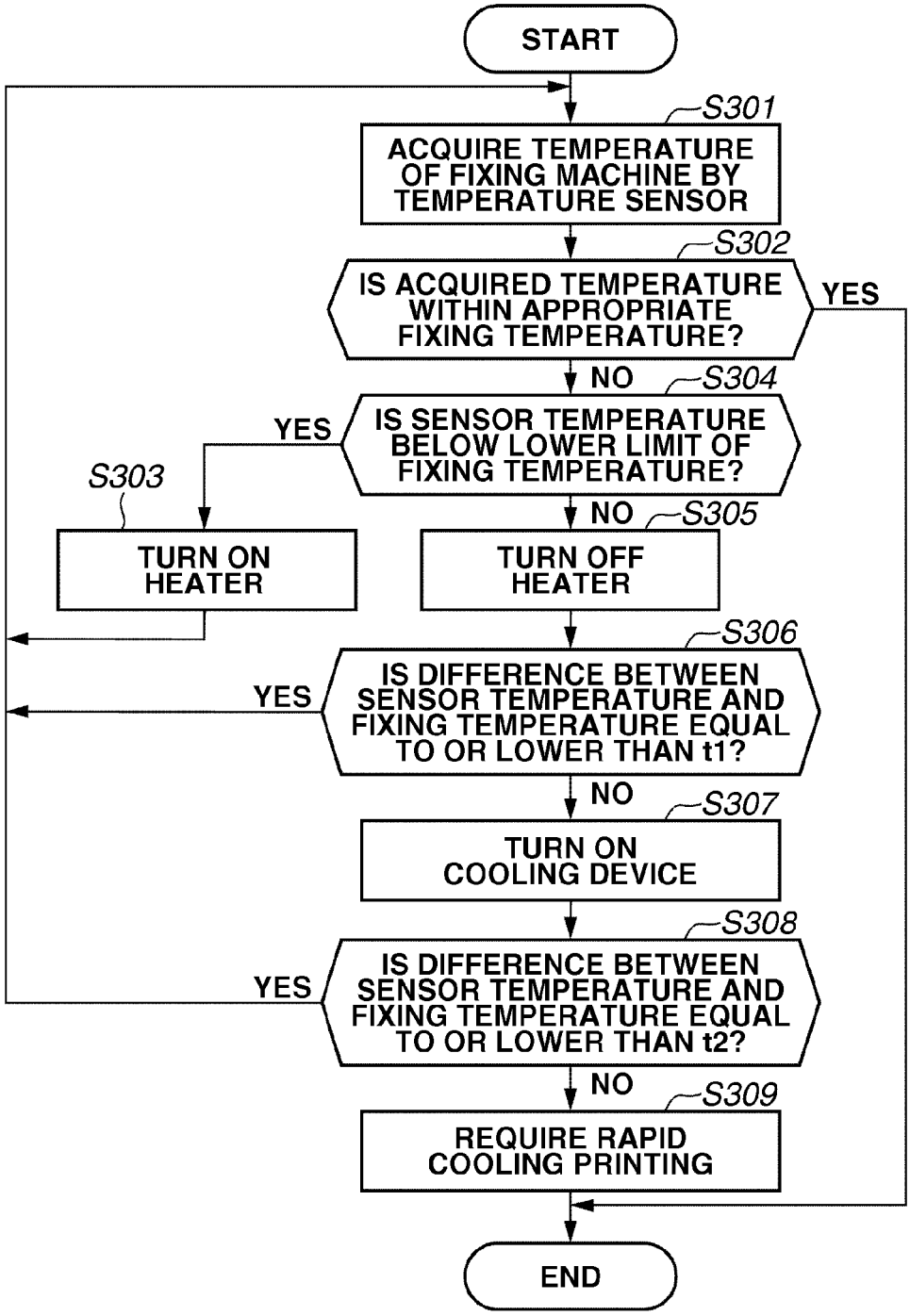
FIG. 10 is a flowchart illustrating details of temperature adjustment processing to be executed in steps S204 to S206 illustrated in FIG. 8.

When temperature adjustment processing in steps S204 to S206 is completed on a first sheet, print processing is started. Successively, temperature adjustment processing in steps S204 to S206 is executed on the sheets subsequent to this. At this time, in step S207, it is determined whether temperature adjustment processing that requires rapid cooling is present in the temperature adjustment processing in steps S204 to S206. Determination criteria in step S207 will be described below together when FIG. 10 is described.

If it is determined that rapid cooling is not required (NO in step S207), this processing ends. The processing proceeds to step S106 (refer to FIG. 6). On the other hand, if it is determined that rapid cooling is required (YES in step S207), the processing proceeds to step S208.

In step S208, a sheet to be used in rapid cooling (cooling sheet) is selected. The CPU executes a predetermined program to function as a selection unit of such a cooling sheet. Selection of the cooling sheet will be described in detail below referring to FIG. 11.

In step S209, when a sheet to be used is determined, an image to be used in rapid cooling is generated. The detailed contents of the image generation will be described below referring to FIG. 12. In step S210, printing for carrying out rapid cooling is executed using the sheet to be used in rapid cooling and the generated image selected in this way.

FIG. 9 is a diagram illustrating an example of sheet information to be acquired in step S202. The sheet information includes "grammage", "surface quality", and "temperature tmax", which indicate the type and the characteristics of a sheet, and "appropriate fixing temperature", "temperature t1", and "temperature t2", which indicate transfer characteristics of a developer to a sheet.

The appropriate fixing temperature has a predetermined width (range) which is determined by a lower limit value and an upper limit value according to a sheet type. The temperature t1 is slightly higher than the fixing temperature, and is a temperature that can be cooled only by turning off the heaters 505 to 507. Temperature t2 is a temperature that can be cooled by turning off the heaters 505 to 507 and operating the cooling devices 508 to 510. The temperature tmax is the maximum temperature that can feed the sheet, and a sheet may dissolve or burn when the sheet is fed at the temperature exceeding temperature tmax.

FIG. 10 is a flowchart illustrating the details of the temperature adjustment processing to be executed in steps S204 to S206. The processing illustrated in the flowchart in FIG. 10 is realized by the CPU 301 reading a program stored in the HDD 304 into the RAM 303, expanding it, and executing it. The contents of each processing of temperature adjustment processing in steps S204 to S206 are similar and the temperature adjustment processing is independently executed. Thus, in the following description concerning FIG. 10, temperature adjustment processing in step S205 is picked up.

First, in step S301, the temperature of the fixing device 501 that is measured by the temperature sensor 503 is acquired. In step S302, the temperature acquired in step S301 and the appropriate fixing temperature acquired in step S203 are compared.

If the temperature acquired in step S301 is within the range of the appropriate fixing temperature acquired in step S203 (YES in step S302), temperature adjustment of the fixing device 501 is not needed. Thus, the processing ends. The end of the processing in FIG. 10 means that the proceeding proceeds to the determination "NO" in step S207 (refer to FIG. 8).

On the other hand, if the temperature acquired in step S301 is not within the range of the appropriate fixing temperature acquired in step S203 (NO in step S302), the processing proceeds to step S304.

In step S304, it is determined whether the temperature acquired in step S301 is lower than the lower limit of the appropriate fixing temperature acquired in step S203. If it is determined that the temperature acquired in step S301 is lower than the lower limit of the appropriate fixing temperature acquired in step S203 (YES in step S304), the processing proceeds to step S303.

In step S303, the heater 506 is turned on and the fixing device 501 is heated. Then the processing returns to step S301. When the processing proceeds to step S303, if the heater 506 has already been turned on, for example, the heater 506 may more strongly be operated to facilitate heating.

On the other hand, if it is determined that the temperature acquired in step S301 is not lower than the lower limit of the appropriate fixing temperature acquired in step S203 (NO in step S304), the processing proceeds to step S305.

In this case, it has been already determined in step S302 that the temperature of the fixing device 501 is not within the range of the appropriate fixing temperature. Thus, the temperature acquired in step S301 exceeds the upper limit of the appropriate fixing temperature acquired in step S203. Thus, in step S305, the operation of the heater 506 is stopped.

Subsequently, in step S306, it is determined whether the temperature acquired in step S301 is lower than the temperature t1 included in the sheet information acquired in step S202.

If it is determined that the temperature acquired in step S301 is lower than the temperature t1 included in the sheet information acquired in step S202 (YES in step S306), since the heater 506 has been already turned off in step S305, the processing returns to step S301.

On the other hand, if it is determined that the temperature acquired in step S301 is not lower than the temperature t1 included in the sheet information acquired in step S202 (NO in step S306), the processing proceeds to step S307. In step S307, the cooling device 509 is turned on, and the fixing device 501 is cooled.

Thereafter, in step S308, it is determined whether the temperature acquired in step S301 is lower than the temperature t2 included in the sheet information acquired in step S202.

If it is determined that the temperature acquired in step S301 is lower than the temperature t2 included in the sheet information acquired in step S202 (YES in step S308), since the cooling device 509 has already been turned on, the processing returns to step S301.

On the other hand if it is determined that the temperature acquired in step S301 is higher than the temperature t2 included in the sheet information acquired in step S202 (NO in step S308), the processing proceeds to step S309. In step S309, it is determined that rapid cooling printing is required. Then, the processing is ended. The end of the processing in FIG. 10 means that the proceeding proceeds to the determination "YES" in step S207 (refer to FIG. 8).

Figure 11:
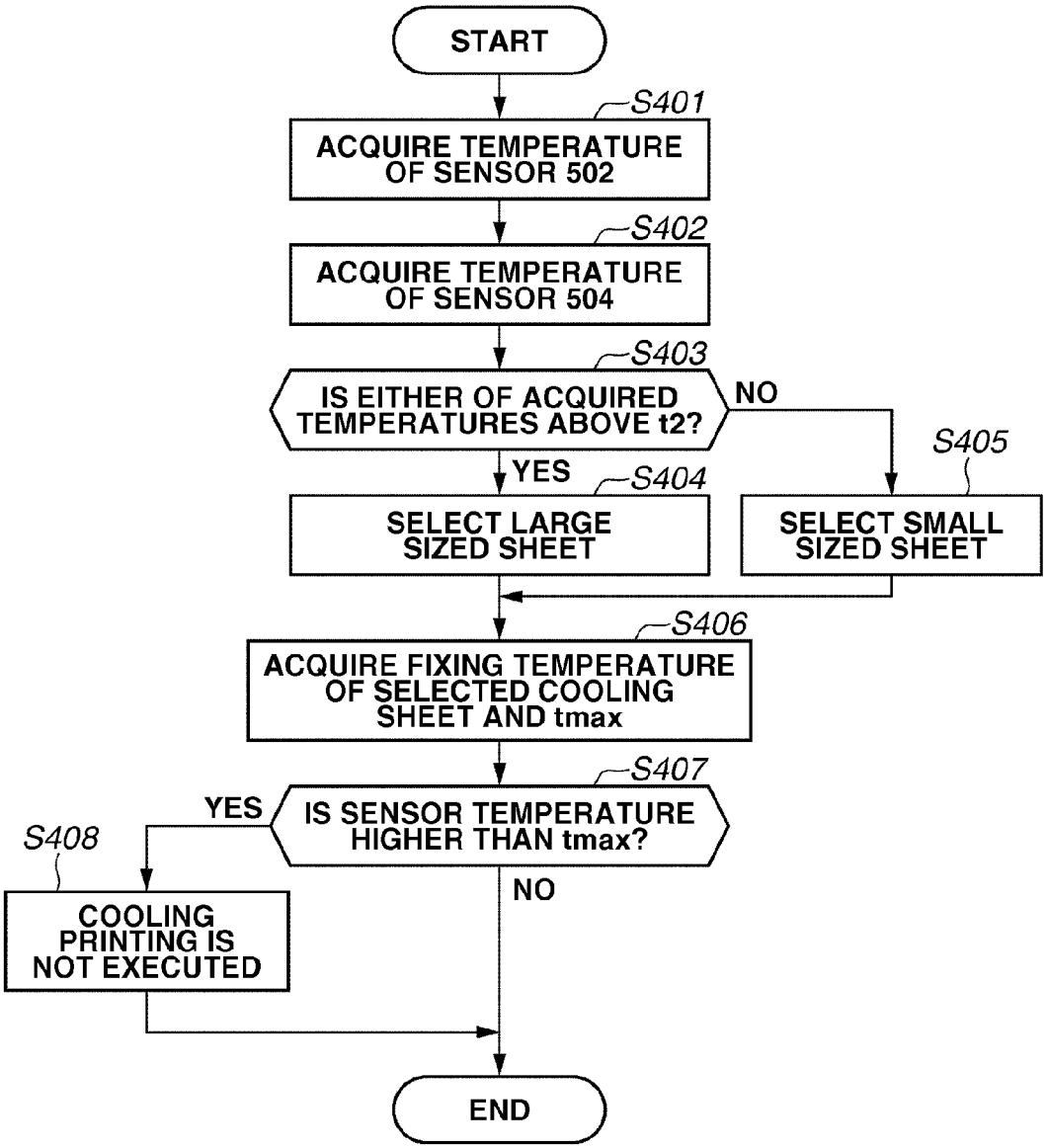
FIG. 11 is a flowchart illustrating details of cooling sheet selection to be executed in step S208 illustrated in FIG. 8.

FIG. 11 is a flowchart illustrating details of the rapid cooling sheet selection to be executed in step S208. The processing illustrated in the flowchart in FIG. 11 is realized by the CPU 301 reading a program stored in the HDD 304 into the RAM 303, expanding it, and executing it.

First, in step S401, the temperature of the temperature sensor 502 is acquired. Subsequently, in step S402, the temperature of the temperature sensor 504 is acquired. Then, in step S403, it is determined whether the temperature acquired in step S401 or the temperature acquired in step S402 is higher than the temperature t2 acquired in step S308.

If it is determined that the temperature acquired in step S401 or the temperature acquired in step S402 is not higher than the temperature t2 acquired in step S308 (NO in step S403), the processing proceeds to step S405.

In step S405, as a sheet size to be used in the rapid cooling, a small sized sheet that passes through only the center of the fixing device 501 is selected. Herein, "small size" refers to a sheet size that is represented by A4 size, Letter size, or the like, however, it is not necessarily limited thereto.

On the other hand, if it is determined that the temperature acquired in step S401 or the temperature acquired in step S402 is higher than the temperature t2 acquired in step S308 (YES in step S403), the processing proceeds to step S404.

In step S404, as a sheet size to be used in rapid cooling, a large sized sheet that passes through the whole fixing device 501 is selected. Herein, "large size" refers to a sheet size that is represented by A3 size, Legal size, or the like, however, it is not necessarily limited thereto. The large sized sheet preferably has a size that passes through both ends of the fixing device 501 as possible.

Next, in step S406, the appropriate fixing temperature of sheets to be used in rapid cooling selected in steps S404 and S405, and the temperature tmax are acquired from sheet information illustrated in FIG. 9. Then, in step S407, it is determined whether the temperatures acquired in steps S401 and S402 are higher than the temperature tmax acquired in step S406.

If it is determined that the temperatures acquired in steps S401 and S402, more specifically the temperature of the fixing device 501, are higher than the temperature tmax acquired in step S406 (YES in step S407), the processing proceeds to step S408. In step S408, the temperature of the sheet selected in step S404 or S405 exceeds the temperature tmax that is the temperature capable of passing papers through the fixing device 501. Thus, the processing ends without executing the rapid cooling printing.

On the other hand, if it is determined that the temperature of the fixing device 501 is lower than the temperature tmax acquired in step S406 (NO in step S407), the processing ends. The end in this case means that the processing proceeds to step S209 (refer to FIG. 8).

Figure 12:
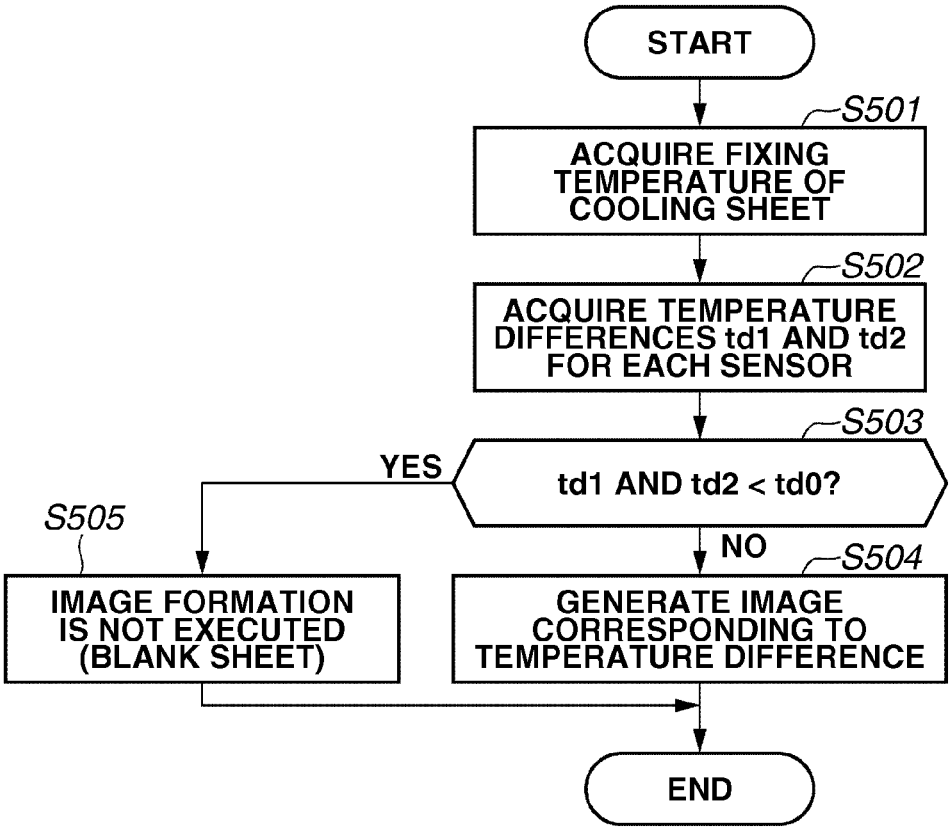
FIG. 12 is a flowchart illustrating details of cooling image generation to be executed in step S209 illustrated in FIG. 8.

FIG. 12 is a flowchart illustrating details of the cooling image generation to be executed in step S209. The processing illustrated in the flowchart in FIG. 12 is realized by the CPU 301 reading a program stored in the HDD 304 into the RAM 303, expanding it, and executing it.

First, in step S501, sheet information of a sheet (rapid cooling sheet) determined by the rapid cooling sheet selection processing in step S208 is acquired, and the appropriate fixing temperature included in the sheet information is acquired. Next, in step S502, temperature difference td1 between temperatures measured by the temperature sensors 502 and 503, and temperature difference td2 between temperatures measured by the temperature sensors 503 and 504 are acquired.

Then, in step S503, it is determined whether both temperature differences td1 and td2 acquired in step S502 are smaller than predetermined value td0. Herein, "predetermined value td0" may be a fixed value or a variable value.

If it is determined that both temperature differences td1 and td2 are smaller than the predetermined value td0 (YES in step S503), the processing proceeds to step S505. In step S505, it is determined that image formation is not executed on a rapid cooling sheet.

If it is determined that both temperature differences td1 and td2 are not smaller than the predetermined value td0 (NO in step S503), the processing proceeds to step S504. In step S504, a cooling image according to the temperature differences td1 and td2 is generated. The contents of processing in step S504 will be described in detail below referring to FIG. 13.

After the processing performed in steps S504 and S505, the processing ends. In FIG. 12, when processing ends through step S504, subsequently, the cooling image is not formed on the rapid cooling sheet and the rapid cooling sheet is conveyed. Thus, rapid cooling of the fixing device 501 is executed. Further, when the processing ends through step S505, subsequently, the cooling image is formed on the rapid cooling sheet and the rapid cooling sheet is conveyed. Thus, the rapid cooling of the fixing device 501 is executed.

Figure 13:
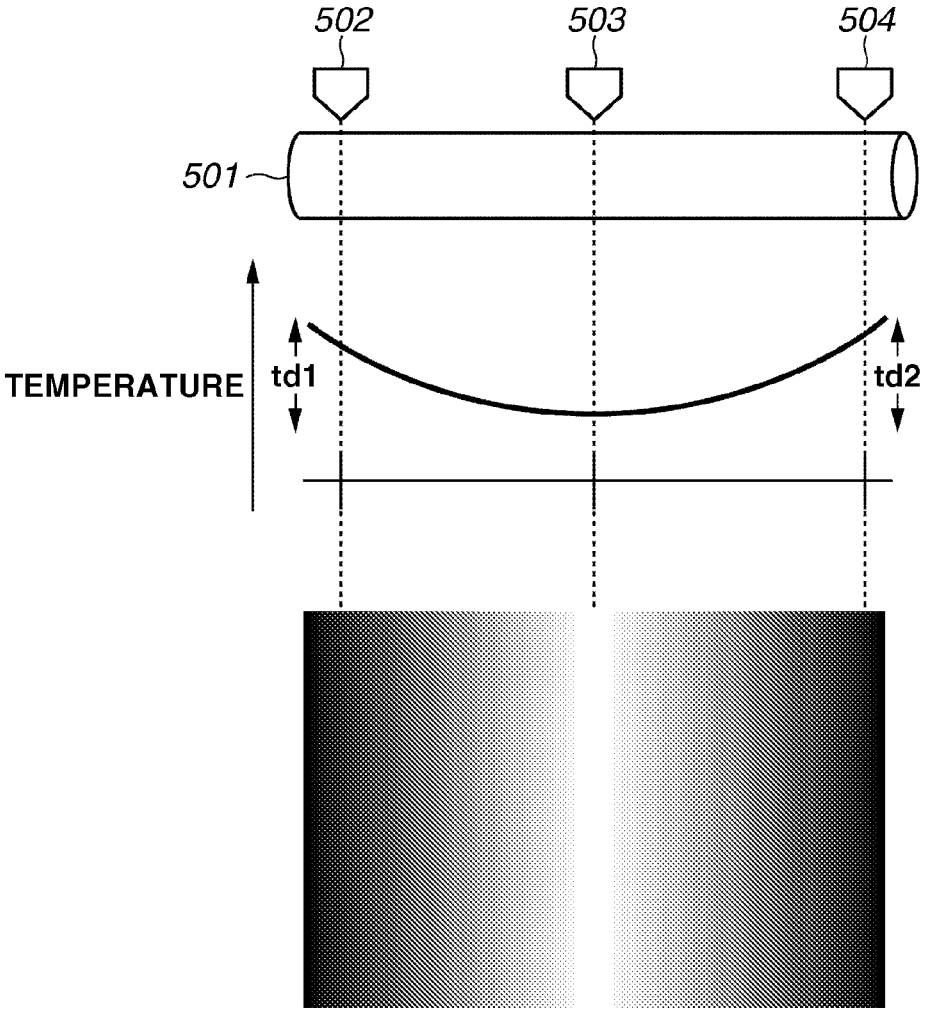
FIG. 13 is a diagram illustrating an example of a cooling image to be generated in step S504 illustrated in FIG. 12.

FIG. 13 is a diagram illustrating an example of a cooling image to be generated in step S504. In FIG. 13, at the top, a positional relationship between the fixing device 501 and the temperature sensors 502 to 504, in the middle, the temperature distribution of the fixing device 501, and at the bottom, an example of a cooling image are illustrated so as to correspond respectively.

When printing on a small sized sheet is continued, only the heater 506 at the center of the path on which an ordinary sheet (middle between small size and large size) passes, and the fixing device 501 is kept at a constant temperature. However, it is known that the temperature at the end of the fixing device 501 rises by thermal conduction. At this time, as illustrated in FIG. 13, in the fixing device 501, the temperature at the edges of the fixing device 501 on which a sheet is not passed may rise compared to the center thereof on which a sheet is passed to give out heat.

In the present exemplary embodiment, even if the fixing device 501 is in such a state, in order to uniformly cool the fixing device 501, in consideration of a temperature difference between the center and the end of the fixing device 501, a rapid cooling image as illustrated in FIG. 13 is generated.

The rapid cooling image is generated so that the higher the temperature of a portion becomes in the fixing device 501, the larger the amount of the developer (toner) to be transferred to the cooling sheet becomes. The developer removes heat from the fixing device 501 and is discharged. Thus, the fixing device 501 can rapidly be cooled. Accordingly, in many cases, the rapid cooling image is an image different from the image that is printed as a job.

A pattern of the rapid cooling image is not limited to that illustrated in FIG. 13. To match a portion needed to execute rapid cooling in the fixing device 501, in other words, in consideration of the temperature distribution of the fixing device 501, the suitable amount of developer is coated and fixed on a sheet. Thus, while the temperature of the fixing device 501 is controlled in an appropriate range, a print processing speed is increased, thereby allowing productivity to be increased.

The above-described print processing is particularly preferable when the temperature needed to fix a developer image on a first sheet is lower than the temperature needed to fix a developer image on a second sheet in a case where image data for a plurality of pages is continuously printed on a plurality of sheets. More specifically, when it is required to change a sheet high in appropriate fixing temperature to a sheet low in appropriate fixing temperature, a suitable cooling sheet is selected and passed through the fixing device 501 until the temperature of the fixing device 501 is set at an appropriate temperature. Thus, the fixing device 501 can rapidly be cooled.

In the present exemplary embodiment, measurement of the temperature of the fixing device 501 by the temperature sensors 502 to 504 is executed for each printing sheet but it is not limited thereto. For example, though depending on the number of printing sheets of the same type to be continuously printed, measurement of the temperature of the fixing device 501 may also be executed by the temperature sensors 502 to 504 only when the type of printing sheets is changed (only when appropriate fixing temperature is changed). This allows a load on the CPU 301 to be decreased.

Aspects of the present invention can also be realized by a computer of a system or apparatus (or devices such as a CPU or MPU) that reads out and executes a program recorded in a memory device to perform the functions of the above-described embodiments, and by a method, the steps of which are performed by a computer of a system or apparatus by, for example, reading out and executing a program recorded in a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-237291 filed Oct. 14, 2009, which is hereby incorporated by reference herein in its entirety.

What is claimed is:

1. An image forming apparatus comprising:

an input unit configured to input image data;

a transfer unit configured to transfer a developer image corresponding to image data input by the input unit to a sheet;

a fixing unit configured to fix the developer image transferred by the transfer unit on the sheet;

a measuring unit configured to measure the temperature of the fixing unit;

a selection unit configured to select a sheet type to be used for cooling the fixing unit based on the temperature measured by the measuring unit; and a control unit configured to perform control so that a sheet of the type selected by the selection unit passes through the fixing unit when the temperature measured by the measuring unit is higher than a predetermined temperature.

2. The image forming apparatus according to claim 1, wherein the measuring unit measures the temperature of the fixing unit when a sheet type to be used for image formation is changed.

3. The image forming apparatus according to claim 1, further comprising:

a determination unit configured to determine the predetermined temperature corresponding to the sheet type to be used for image formation.

4. The image forming apparatus according to claim 1, further comprising a heating unit configured to raise the temperature of the fixing unit, wherein the control unit performs control so that the heating unit is turned off when the temperature measured by the measuring unit is higher than a first temperature that is higher than the predetermined temperature.

5. The image forming apparatus according to claim 4, further comprising a cooling unit configured to cool the fixing unit, wherein the control unit performs control so that the cooling unit is turned on when the temperature measured by the measuring unit is higher than a second temperature that is higher than the predetermined temperature.

6. The image forming apparatus according to claim 1, wherein the measuring unit measures temperatures at a plurality of positions of the fixing unit, and wherein the control unit performs control so that the developer image is not transferred to the sheet and the sheet passes through the fixing unit when a difference in temperatures at the plurality of positions is smaller than a predetermined value.

7. The image forming apparatus according to claim 6, wherein the control unit performs control so that a cooling developer image is transferred, which is different from the developer image corresponding to the image data input by the input unit, and the sheet passes through the fixing unit when a difference in temperatures at the plurality of positions is larger than a predetermined value.

8. The image forming apparatus according to claim 7, wherein the control unit performs control so that the cooling developer image is transferred to the sheet, the higher the temperature of a portion of the fixing unit becomes, the larger the amount of a developer to be transferred to a portion of the sheet corresponding to the portion of the fixing unit becomes.

9. A method for controlling an image forming apparatus including an input unit configured to input image data, a transfer unit configured to transfer a developer image corresponding to image data input by the input unit, to a sheet, and a fixing unit configured to fix the developer image transferred by the transfer unit on the sheet, the method comprising:

measuring the temperature of the fixing unit;

selecting a sheet type to be used for cooling the fixing unit based on the measured temperature; and performing control so that a sheet of the selected type passes through the fixing unit when the measured temperature is higher than a predetermined temperature.

10. A non-transitory computer-readable storage medium storing computer-executable instructions for controlling an image forming apparatus including an input unit configured to input image data, a transfer unit configured to transfer a developer image corresponding to image data input by the input unit to a sheet, and a fixing unit configured to fix the developer image transferred by the transfer unit on the sheet, which, when executed by a computer, cause the computer to perform operations comprising:

measuring the temperature of the fixing unit;

selecting a sheet type to be used for cooling the fixing unit based on the measured temperature; and performing control so that a sheet of the selected type passes through the fixing unit when the measured temperature is higher than a predetermined temperature.

* * * * *